US007358833B2

(12) United States Patent
Krupenkin et al.

(10) Patent No.: US 7,358,833 B2
(45) Date of Patent: Apr. 15, 2008

(54) METHOD AND APPARATUS FOR SIGNAL PROCESSING USING ELECTROWETTING

(75) Inventors: Thomas Nikita Krupenkin, Warren, NJ (US); Carsten Metz, Chatham Township, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 204 days.

(21) Appl. No.: 11/375,223

(22) Filed: Mar. 14, 2006

(65) Prior Publication Data

US 2007/0216497 A1 Sep. 20, 2007

(51) Int. Cl.
*H01P 1/20* (2006.01)
*H01P 1/18* (2006.01)

(52) U.S. Cl. ..... 333/202; 333/156; 333/157; 333/161

(58) Field of Classification Search ..... 333/156, 333/157, 160, 161, 202
See application file for complete search history.

(56) References Cited

U.S. PATENT DOCUMENTS 3,631,501 A * 12/1971 Buscher ..... 343/754
5,912,606 A * 6/1999 Nathanson et al. ..... 335/47
6,323,447 B1 * 11/2001 Kondoh et al. ..... 200/182
6,538,823 B2 3/2003 Kroupenkine et al.
6,545,815 B2 4/2003 Kroupenkine et al.
6,689,976 B1 * 2/2004 Dove et al. ..... 200/182
6,717,495 B2 * 4/2004 Kondoh et al. ..... 335/47
6,743,991 B1 * 6/2004 Wong et al. ..... 200/182
6,756,551 B2 * 6/2004 Wong ..... 200/214
6,765,162 B2 * 7/2004 Wong et al. ..... 200/182
6,891,682 B2 5/2005 Aizenberg et al.
6,936,196 B2 8/2005 Chandross et al.
7,012,482 B2 * 3/2006 Rawnick et al. ..... 333/156
7,046,104 B2 * 5/2006 Snyder et al. ..... 333/205
7,211,754 B2 * 5/2007 Wang et al. ..... 200/182

* cited by examiner

*Primary Examiner*—Robert J. Pascal
*Assistant Examiner*—Kimberly E Glenn

(57) ABSTRACT

An apparatus comprising a tuning device having at least one control electrode and a ground electrode located over a substrate and an electrically conductive fluid in contact with the control and ground electrodes. The tuning device also has at least one electrical transmission line electrically coupled to the fluid, the transmission line configured to transmit a signal. The fluid is configured to move when a voltage is applied between the ground electrode and the control electrode, the movement of the fluid changing a propagation characteristic of the signal.

20 Claims, 6 Drawing Sheets

METHOD AND APPARATUS FOR SIGNAL PROCESSING USING ELECTROWETTING

TECHNICAL FIELD OF THE INVENTION

The present invention is directed, in general, to a device for processing an electrical signal, and methods for using and manufacturing such a device.

BACKGROUND OF THE INVENTION

Tuning devices are important components in a variety of electrical apparatuses such as radiofrequency (RF) and microwave devices, power amplifiers, mixers, and antenna systems. The tuning device is used to adjust the propagation characteristics (e.g., the amplitude or phase at a given frequency) of the electrical signal traveling through components of the apparatus. Examples of such tuning devices include hybrid couplers, RF-tuning networks, resonance filters and tunable antennas. A common feature in all of these forms of tuning devices is that moveable mechanical tuning components are used to adjust the signal's properties.

One problem with the use of moveable mechanical tuning components is that they wear out over time. Repeated use can cause the moving components to fail, resulting in a decrease in the lifetime of the apparatus that the tuning device operates on. Another problem is that moveable components that are not used frequently can become stuck or fused together, resulting in their failure when pressed into use. Still another problem is that the position of a moveable tuning component can be inadvertently changed, due to the motion or vibration of the apparatus. This, in turn, can cause de-tuning of a previously tuned signal. Moreover, the problem of mechanical wear or sticking are exacerbated as the dimensions of the moveable components are scaled down. Additionally, the manufacturing processes associated with integrating moveable micromechanical components into increasingly smaller devices have increased complexity and cost.

SUMMARY OF THE INVENTION

To address one or more of the above-discussed deficiencies, one embodiment of the present invention is an apparatus. The apparatus comprises a tuning device. The tuning device comprises at least one control electrode and a ground electrode located over a substrate, and an electrically conductive fluid in contact with the control and ground electrodes. The tuning device also comprises at least one electrical transmission line electrically coupled to the fluid, the transmission line being configured to transmit a signal. The fluid is configured to move when a voltage is applied between the ground and control electrodes. The movement of the fluid changes a propagation characteristic of the signal.

Another embodiment is a method that comprises changing a signal propagation characteristic of a transmission line. Changing the signal propagation characteristic comprises moving an electrically conductive fluid by applying a voltage between at least one control electrode and a ground electrode, both of the electrodes being in contact with the fluid. Moving the fluid changes a conductive path of the transmission line, which is electrically coupled to the fluid.

Still another embodiment is a method that comprises manufacturing a tuning device. One or more each of a transmission line, a ground electrode and a controlling electrode are formed over a substrate. An electrically conductive fluid is positioned in contact with the ground electrode and controlling electrode and electrically coupled to the transmission line.

BRIEF DESCRIPTION OF THE DRAWINGS

The invention is best understood from the following detailed description, when read with the accompanying FIGURES. Various features may not be drawn to scale and may be arbitrarily increased or reduced in size for clarity of discussion. Reference is now made to the following descriptions taken in conjunction with the accompanying drawings, in which.

DETAILED DESCRIPTION

The embodiments benefit from the realization that moveable solid mechanical tuning components of a tuning device can be replaced with a fluid. Because the moving component is now a fluid, there is substantially no mechanical wear or sticking, resulting in longer-lived and more reliable tuning devices. Such tuning devices are relatively simple and inexpensive to manufacture compared to conventional tuning devices having moving mechanical parts. Moreover, if desired, certain fluid tuning components can be solidified after tuning, thereby locking the tuning property of the device.

One embodiment is an apparatus. The tuning device can be a component in the apparatus or comprise the apparatus itself. As further discussed below, the apparatus can comprise a tuning device having a variety of configurations, including a variable phase shifter, a resonator or a filter.

Figure 1:
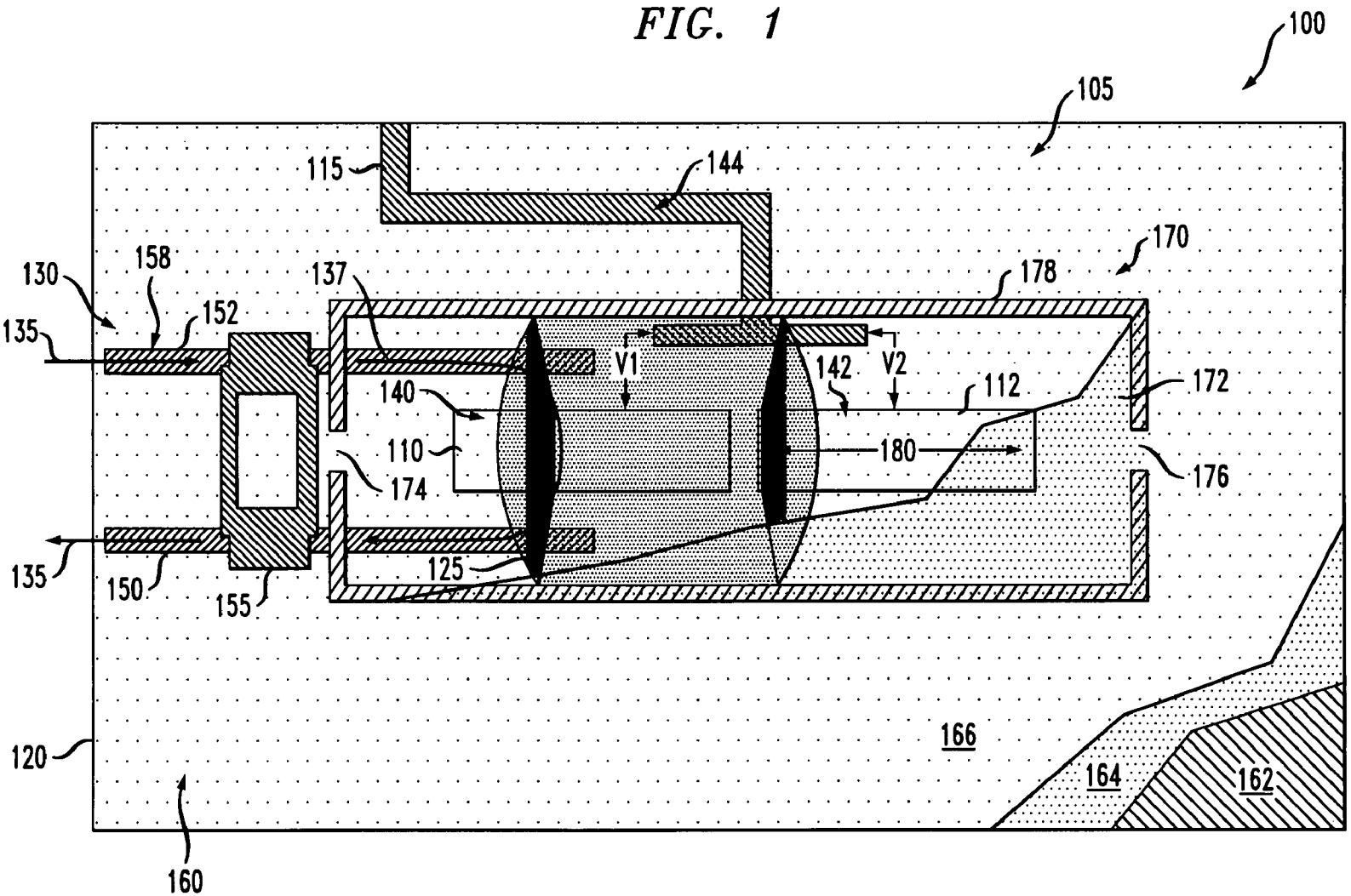
FIG. 1 presents a plan view of an exemplary embodiment of an apparatus comprising a variable phase shifter tuning device.

FIG. 1 presents a detailed plan view of an exemplary embodiment of an apparatus 100 comprising a variable phase shifter-tuning device 105. The tuning device 105 can be advantageously used in an apparatus 100 that comprises a phased-array antenna, for example. The tuning device 105 comprises at least one control electrode, in this case, two control electrodes 110, 112, and a ground electrode 115, both located over a substrate 120. The tuning device 105 further comprises an electrically conductive fluid 125 that is in contact with the control electrodes 110, 112 and the ground electrode 115. The fluid 125 is presented as semitransparent so that underlying structures can be clearly depicted.

The tuning device 105 also comprises at least one electrical transmission line 130 that is electrically coupled to the fluid 125. The transmission line 130 is configured to transmit a signal 135, e.g., an electromagnetic wave, such as a microwave or a radio wave. The term, electrically coupled, as used herein means that the signal 135 propagating through the transmission line 130 is affected through capacitive or inductive coupling to, or direct electrical contact with, the fluid 125. The fluid 125 is configured to move when a voltage (V1, V2, respectively) is applied between the one or more control electrodes 110, 112 and the ground electrode 115. The movement of the fluid 125 changes a propagation characteristic of the signal 135.

In some embodiments, the propagation characteristic comprises a resonant behavior, and changing the propagation characteristic comprises changing the resonance frequency of the signal 135. As an example, moving the droplet of conductive fluid 125 changes a conductive path 137 (e.g., the resonator length) that the signal 135 traverses through the transmission line 130, because the conductive fluid 125 causes a short circuit. Changing the conductive path 137, in turn, changes the wavelength at which a standing wave can exist on the transmission line 130. In other cases, the propagation characteristic comprises a filter response and changing the propagation characteristic comprises changing the filter response of the transmission line 130. Consequently, the amplitude or phase of the signal 135 at a particular wavelength or range of wavelengths can be increased or decreased.

Changing the position of the fluid 125 by applying a voltage as described above occurs via a phenomenon termed electrowetting. Electrowetting can move the fluid by attracting it towards the higher voltage difference between the fluid and a plurality of electrodes. Alternatively, electrowetting can move the fluid by causing the fluid to spread out on a surface when a voltage is applied between the fluid and an electrode (or to contract when the voltage is turned off). The movement of fluids in this fashion is described in U.S. Pat. Nos. 6,538,823, 6,545,815, 6,891,682 and 6,936,196, which are incorporated by reference herein in their entirety.

For apparatus 100 illustrated in FIG. 1, for example, when the voltage difference, regardless of polarity, between the fluid 125 and the first control electrode 110 is greater than the voltage difference between the fluid 125 and the second control electrode 112, then the fluid droplet 125 will tend to move towards the first control electrode 110 and away from the second control electrode 112. For instance, to move the fluid droplet 125 laterally towards the transmission line 130, a non-zero voltage ($V1 \neq 0$) can be applied to the first control electrode 110, and zero voltage can be applied to the second control electrode 112 ($V2=0$). Conversely, to move the fluid droplet 125 towards the transmission line 130, zero voltage ($V1=0$) can be applied to the first control electrode 110, and a non-zero voltage can be applied to the second control electrode 112 ($V2 \neq 0$).

As illustrated in FIG. 1, moving the fluid 125 towards the transmission line 130 shortens the conductive path 137 that the signal 135 traverses through the transmission line 130. The signal 135 is reflected at the electrically conductive fluid 125 as it causes a short circuit. The conductive path 137 does not include the control electrodes 110, 112 and ground electrode 115 because these structures are insulated. Conversely, moving the fluid 125 away from the transmission line 130 lengths the conductive path 137. In turn, changing the conductive path 137 changes the signal propagation characteristic.

The fluid 125 can comprise one or more droplet located on the control electrodes. For the embodiment illustrated in FIG. 1, a single fluid droplet 125 rests on the two control electrodes 110, 112. Examples of suitable electrically conductive fluids 125 include aqueous salt solutions and molten salts. Exemplary aqueous salt solutions include 0.01 molar solutions of salts such as LiN, LiCl, $KNO_3$, or KCl. Exemplary molten salts include 1-Ethyl-3-methylimidazolium tetrafluoroborate and 1-Ethyl-3-methylimidazolium trifluoromethanesulfonate, which are both commercially available. In other cases the fluid 125 can comprise liquid metals such as, gallium indium or mercury.

In other cases the fluid 125 can comprises a material that is capable of being solidified. In particular, the fluid 125 can be solidified when one or more of the above-mentioned propagation characteristics are attained. Solidification can be used to advantageously lock the tuning device 105 into providing a desired signal propagation characteristic. Solidification makes changes in the signal propagation characteristic more resistant to environmental influences, such as changes in temperature or movement of the apparatus 100, such as physical vibrations through the device 105.

In some preferred embodiments, the solidifiable fluid 125 comprises a photopolymerizable liquid, obtained, e.g., by mixing an optically curable liquid such as Norland Optical Adhesive "NA-61" (manufactured and distributed by Norland Products Inc. of Cranbury, N.J.) with 0.01 wt percent of molten salt (e.g., 1-ethyl-3-methyl-1H imidazolium tetrafluoroborate, available from Sigma-Aldrich Corporation of St. Louis, Mo.). Other examples are presented in the above-referenced U.S. Pat. No. 6,936,196 patent. One of ordinary skill in the art would be familiar with how to select and mix other type of curable liquids and conductive additives to form the fluid.

The control electrodes 110, 112 and ground electrode 115 can be made of any solid conductive material, such as gold or aluminum, or indium tin oxide glass. In some preferred embodiments control electrodes 110, 112 and the ground electrode 115 comprise copper film or platinum wire. In certain preferred embodiments, the control electrodes 110, 112 have flat featureless surfaces 140, 142. In other cases, however, the fluid 125 can be moved on control electrodes having surfaces 140, 142 that comprise microstructured or nanostructured features such as discussed in U.S. Patent Applications 2005/0039661 and 2004/0191127, which are incorporated by reference herein in their entirety.

The surfaces 140, 142 of the control electrode 110, 112 and the surface 144 of the ground electrode 115 that can contact the fluid 125 are electrically insulated. The insulator on these surfaces 140, 142, 144 can comprise any solid dielectric such as silicon nitride, or solid polymers, such as polyimide and parylene. In some cases, it is also desirable for surface 140, 142 of the control electrode 110, 112 or the surface 144 of the ground electrode 115 to also include a low surface energy material. The low surface energy material facilitates obtaining a high contact angle (e.g., about 90 degrees or more) of the fluid 125 on the electrodes 110, 112, 115, thereby improving the fluid's 125 mobility. The term low surface energy material, as used herein, refers to a material having a surface energy of about 22 dyne/cm (about $22 \times 10^{-5}$ N/cm) or less. Those of ordinary skill in the art would be familiar with the methods to measure the surface energy of materials. Examples of suitable materials include fluorinated polymers like polytetrafluoroethylene. In some cases, these surfaces 140, 142, 144 are covered with a single material, such as Cytop® (Asahi Glass Company, Limited Corp. Tokyo, Japan), a fluoropolymer that is both an electrical insulator and low surface energy material.

In some embodiments of the tuning device the transmission line 130 comprises a microstrip line, which can be e.g., realized by placing a metal strip on an insulating substrate 120. For example, for the variable phase shifter-tuning device 105 depicted in FIG. 1, the transmission line 130 comprises two microstrip lines 150, 152. As further illustrated the microstrip lines 150, 152 are in contact with the fluid 125 and electrically coupled to a conventional hybrid coupler 155 such as a 90-degree hybrid coupler. The transmission line 130 can comprise the same types of conductive materials as used to form the control and ground electrodes 110, 112, 115. Likewise, the surface 158 of the transmission line 130 that the fluid 125 contacts can further include a low surface energy material such as described above for the control and ground electrodes 110, 112, 115.

The substrate 120 can comprise any solid material, such as a glass or a solid polymer, used in the construction of conventional printed circuit boards. In some instances, the substrate 120 comprises a conducting plane 162 separated from the transmission line 130 by a dielectric layer 164, adjacent to the conducting plane 162. The substrate 120 can also comprise a low surface energy material, such as polytetrafluoroethylene, or polymers based on monomers of p-xylylene $CH_2{:}C_6H_4{:}CH_2$ (e.g., parylene). Alternatively, as illustrated in FIG. 1, the substrate surface 160 that the fluid 125 can contact can be covered with a low surface energy material 166. In some cases, such as illustrated in FIG. 1 the substrate surface 160 that the fluid 125 rests on has a substantially planar geometry.

In some preferred embodiments, such as illustrated in FIG. 1, the tuning device 105 further comprises a channel 170. For example, the channel 170 can be located on the substrate 120, and the fluid 125 located in the channel 170. A semi-transparent view of the top enclosure 172 of the channel 170 is presented so that the underlying structures can be clearly depicted. As further illustrated in FIG. 1, channel 170 comprises at least two openings 174, 176. The openings 174, 176 are configured to normalize an atmospheric pressure inside the channel 170 when the fluid 125 moves. Of course, other embodiments can comprise an open-topped channel 170 having just lateral enclosures 178 that constrain the fluid's 125 lateral movement over the substrate 120.

The channel 170 beneficially constrains the fluid's 125 movement over the substrate 120. At least portions of the transmission line 130 (e.g., the microstrip lines 150, 152), the control electrodes 110, 112, and the ground electrode 115 are located within the channel 170. As illustrated for the embodiment shown in FIG. 1, the channel 170 can extend laterally around the control electrodes 110, 112, thereby guiding the fluid droplet's 125 movement along a long axis 180 of the electrodes 110, 112. The channel enclosures 172, 178 can be composed of an solid insulating material, including photoresist material such as epoxy resin. In some cases, the channel enclosures 172, 178 are composed of, or covered with, the same low surface energy material that is used to cover the electrodes 110, 112, 115 or transmission line 130.

Figure 2:
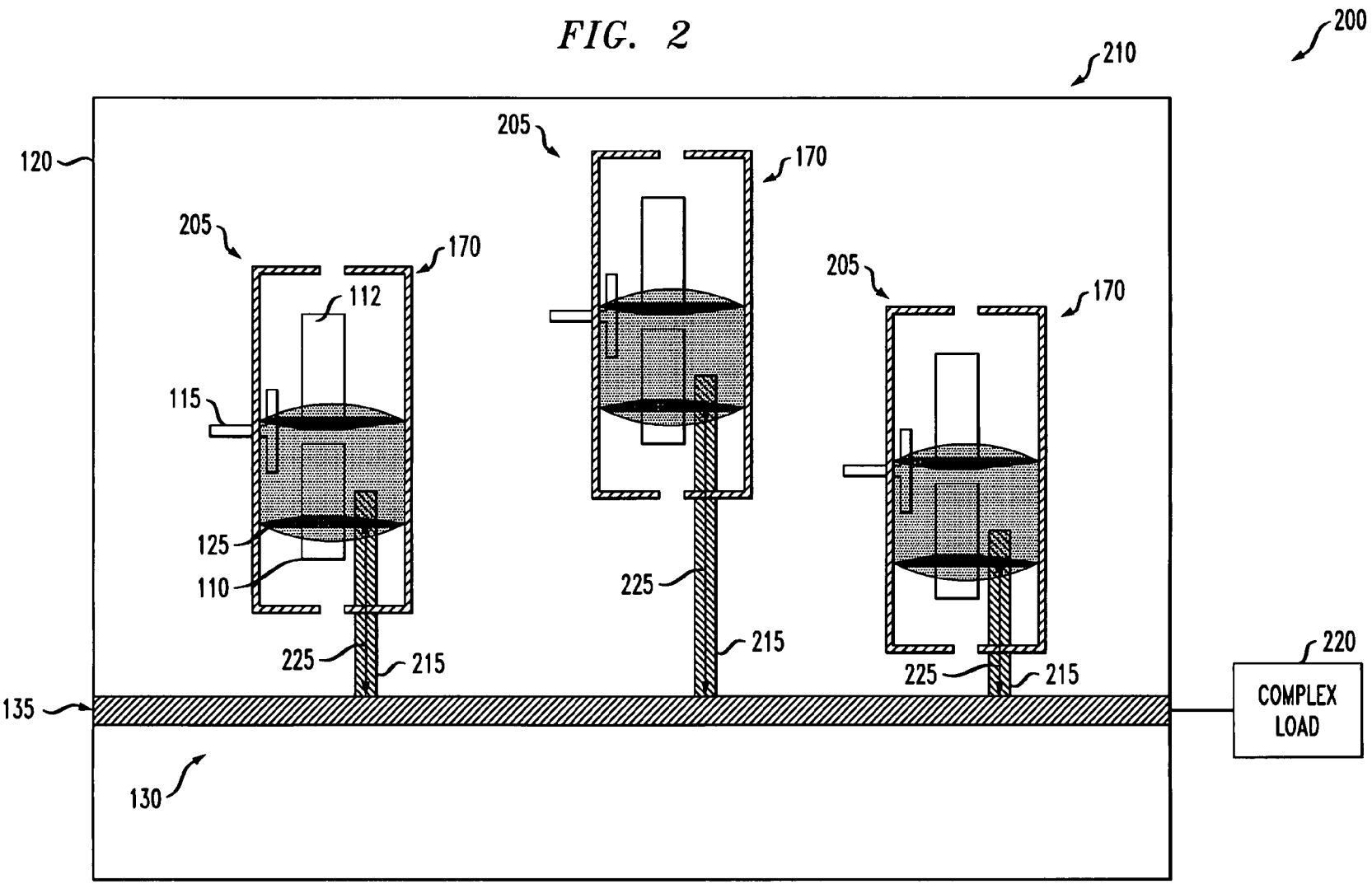
FIG. 2 presents a plan view of a second exemplary embodiment of an apparatus comprising an RF-tuning device.

Some embodiments of the apparatus have a plurality of tuning devices. FIG. 2 presents a detailed plan view of a second exemplary embodiment of an apparatus 200 comprising a plurality of RF-tuning devices 205. The same reference numbers are used to depict device components that are analogous to that discussed above in the context of FIG. 1. Any of the above-described embodiments of these components can be applied in the RF-tuning device 205.

In some cases, the plurality of the RF-tuning devices 205 are used to form a RF-tuning network 210 to change the signal propagation characteristic of a transmission line 130 coupled to an apparatus 200 such as a tunable wide-band antenna. Each RF-tuning device 205 of the network 210 comprises at least one control electrode 110, 112 and a ground electrode 115 located over a substrate 120, an electrically conductive fluid 125 in contact with the control and ground electrodes 110, 112, 115, and at least one electrical transmission line 130 electrically coupled to the fluid. In some preferred embodiments the transmission line 130 comprises a microstrip or a coplanar waveguide. As well known to those skilled in the art, coplanar transmission lines comprise a single strip mounted between two ground planes on the same side of a dielectric substrate. As shown in FIG. 2, the RF-tuning devices 205 can optionally include a channel 170.

As further illustrated in FIG. 2, the transmission line 130 can have a plurality of tuning stubs 215 that contact individual ones of the fluid 125 in a particular device 205. The transmission line 130 can be coupled to a complex load 220, that is, a load that has both resistive and reactive impedance. A complex load can be presented by, e.g., an antenna or packaged Microwave Monolithic Integrated Circuit (MMIC).

Individual RF-tuning devices 205 can be configured to adjust a signal propagation characteristic of the transmission line 130 by moving its respective fluid 125 as described above in the context of FIG. 1. The propagation characteristic (e.g., one or more of the frequency, amplitude or phase of the signal 135) can be changed by altering a conductive path 225 of the tuning stub 215, by moving the fluid 125. Consequently, the RF-tuning device 205, or RF-tuning network 210, can be used to match the impedance of the transmission line 130 to that of the complex load 220.

Figure 3:
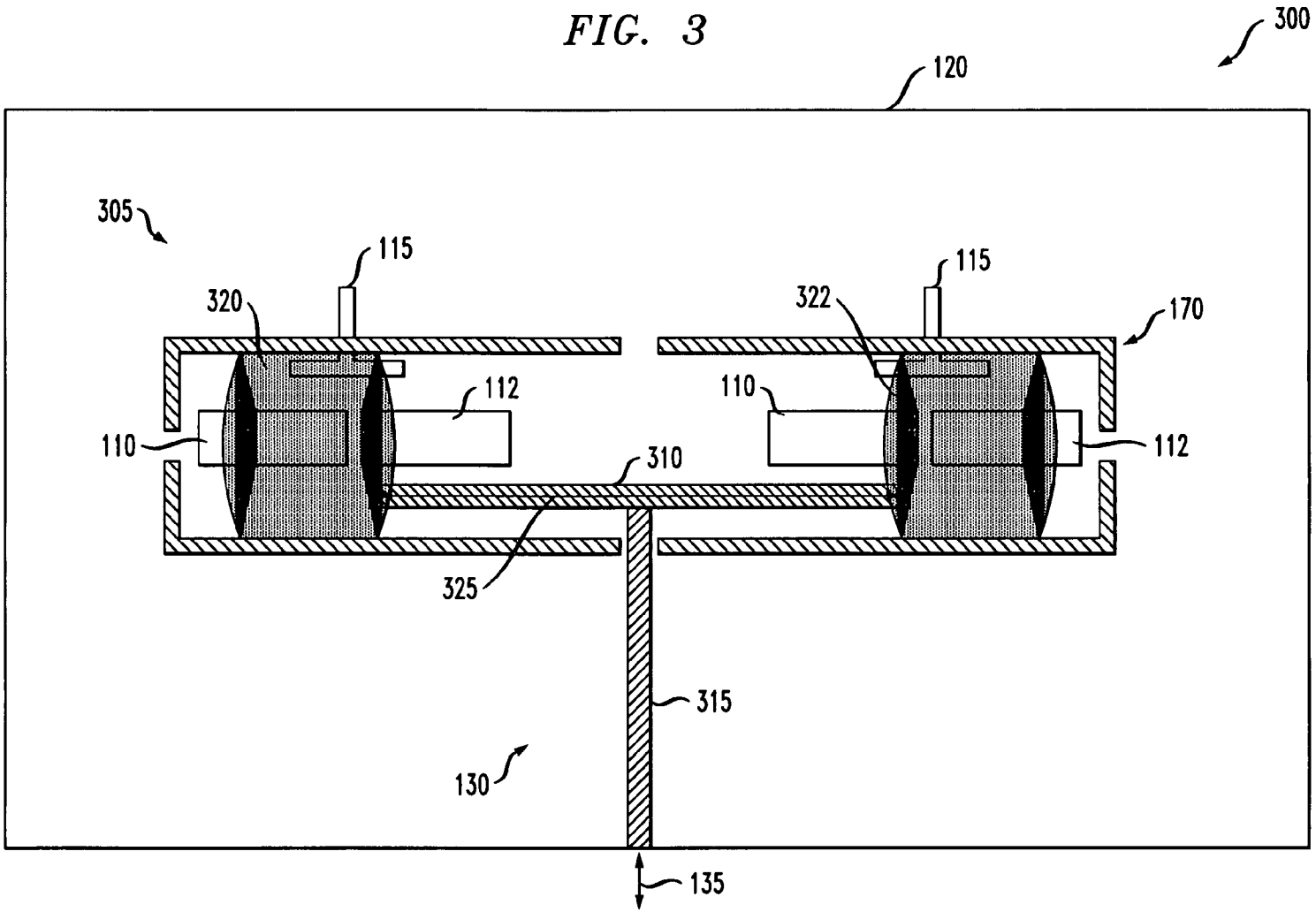
FIG. 3 presents a plan view of a third exemplary embodiment of an apparatus comprising a resonator-tuning device.

FIG. 3 presents a detailed plan view of a third exemplary embodiment of an apparatus 300 comprising a resonator-tuning device 305. Again, the same reference numbers are used to depict device components that are analogous to that discussed above in the context of FIG. 1. Any of the above-described embodiments of these components can be applied in the resonator-tuning device 305.

As illustrated in FIG. 3, the resonator-tuning device 305 comprises control and ground electrodes 110, 112, 115 located over a substrate 120, an electrically conductive fluid 125 and an electrical transmission line 130, configured similar to that described above for FIGS. 1-2. The transmission line 130 can be coupled to an apparatus 300 such as an oscillator or filter. The transmission line 130 can comprise a microstrip or a coplanar waveguide. As shown in FIG. 3, the tuning devices 305 can optionally include a channel 170.

As further illustrated in FIG. 3, the transmission line 130 includes a tuning stub 310 and a feed line 315. The tuning stub 310 can contact the fluid 125. In some cases, such as shown in FIG. 3, the fluid 125 comprises two droplets 320, 322 that contact opposing ends of the tuning stub 310. By moving the droplets 320, 322 towards or away from each other, a conductive path 325 of the tuning stub 310 is changed, thereby changing the propagation characteristic of the signal 135.

Other embodiments of the tuning devices would be readily apparent to those of ordinary skill in the art. For example, in another embodiment of the tuning device 305, any one or all of the pairs of control electrodes 110, 112 can be replaced by a single control electrode. The fluid droplets 125 can be moved towards each other by apply a voltage between the single electrode and ground electrode, such that the droplet 125 spreads over the electrode and substrate. This in turn changes the conductive path 325 of the tuning stub 310.

Figure 4:
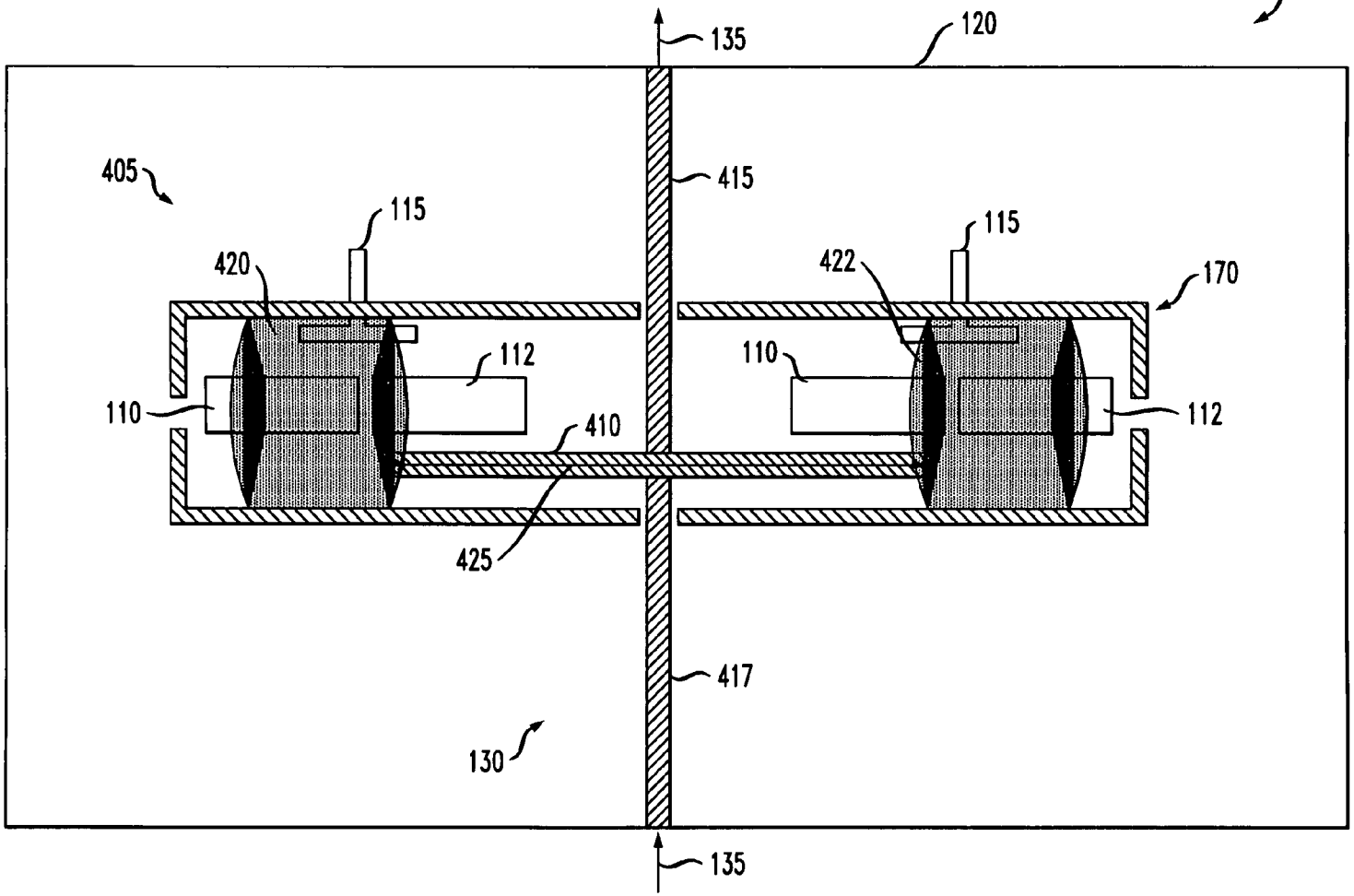
FIG. 4 presents a plan view of a fourth exemplary embodiment of an apparatus comprising a filter tuning device.

FIG. 4 presents a detailed plan view of a fourth exemplary embodiment of an apparatus 400 comprising a filtering-tuning device 405. Again, the same reference numbers are used to depict device components that are analogous to that discussed above in the context of FIG. 1. Any of the above-described embodiments of these components can be applied in the resonator-tuning device 405.

As illustrated in FIG. 4, the resonator-tuning device 405 comprises control and ground electrodes 110, 112, 115 located over a substrate 120, the electrically conductive fluid 125 and the electrical transmission line 130, configured as described above. The transmission line 130 can be coupled to an apparatus 400 such as an oscillator or filter. The transmission line 130 can comprise a microstrip or a coplanar waveguide. As shown in FIG. 4, the tuning devices 405 can optionally include a channel 170.

As further illustrated in FIG. 4, the transmission line 130 can have a tuning stub 410 and input and output lines 415, 417 that are coupled to the tuning stub 410. Analogous to the device 305 discussed in the context of FIG. 3, the tuning stub 410 can contact the fluid 125, and as shown in FIG. 4, the fluid 125 can have two droplets 420, 422 that contact opposing ends of the tuning stub 410. Once again, by moving the droplets 420, 422 towards or away from each other, a conductive path 425 of the tuning stub 410 is changed, thereby changing the propagation characteristic of the signal 135.

Variations in the tuning devices depicted in FIGS. 1-4 would be readily apparent to those of ordinary skill in the art. For example, for any of these tuning devices, one or all of the pairs of control electrodes 110, 112 could be replaced by a single control electrode, as discussed above in the context of FIG. 3. Additionally, the apparatus could comprise a plurality of the same type or combinations of the different types of tuning devices.

Figure 5:
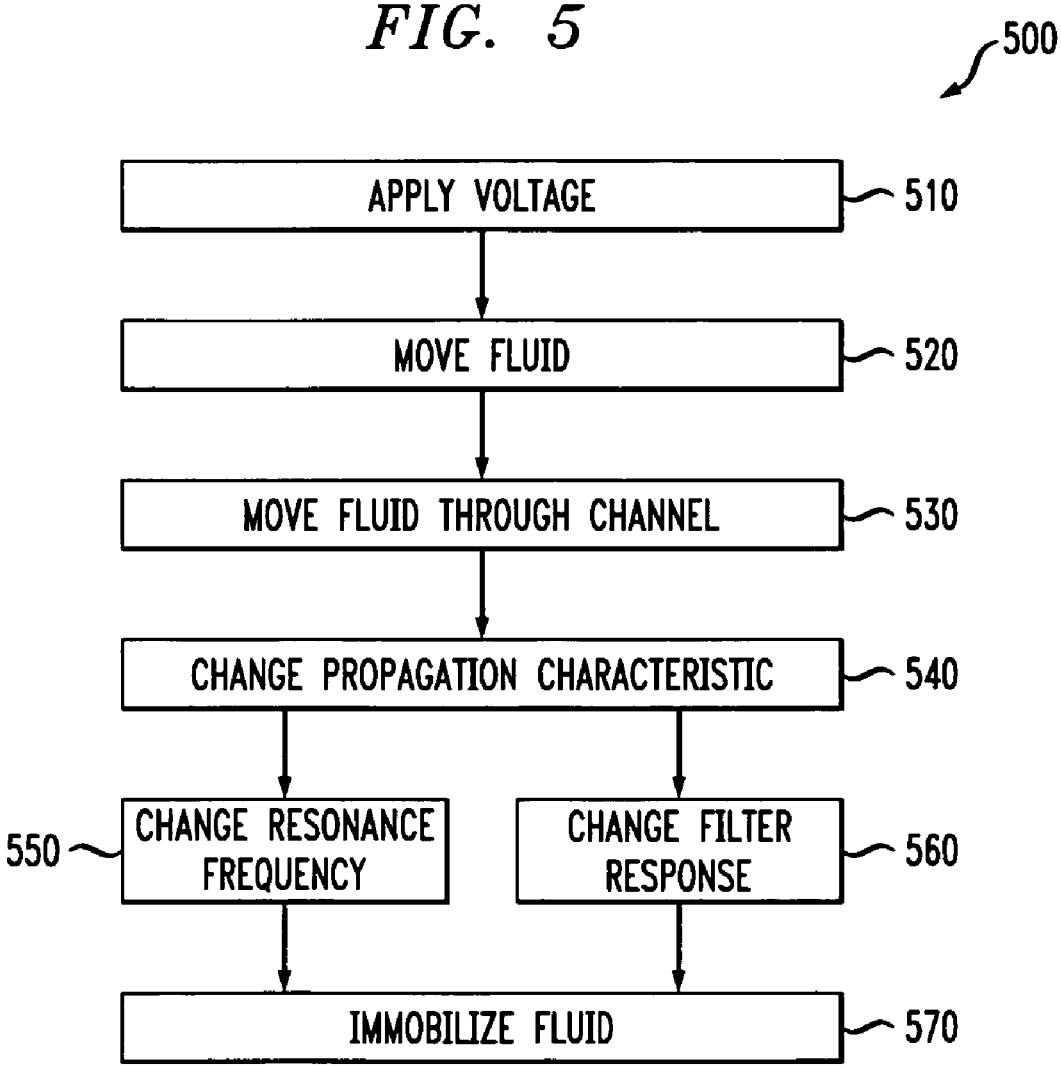
FIG. 5 presents a flow diagram of a method at selected stages of using an exemplary embodiment of an apparatus.

Yet another embodiment is a method of use. FIG. 5 presents a flow diagram of a method 500 at selected stages of changing a signal propagation characteristic of a transmission line. Any of the exemplary embodiments of apparatuses presented and their tuning devices presented in FIGS. 1-4 could be used to implement the method.

The method 500 comprises a step 510 of applying a voltage between at least one control electrode and a ground electrode, both of the electrodes being in contact with an electrically conductive fluid. The applied voltages depend upon the selected materials, the layout of the tuning device, and the desired extent of movement of the fluid. Typical voltages may vary between 0 volts and approximately 200 volts, although the acceptable voltages are not limited to this range.

The method 500 also comprises a step 520 of moving the electrically conductive fluid, thereby changing a conductive path of the transmission line electrically coupled to the fluid. The applied voltage attracts the fluid towards the higher voltage difference or causes the fluid to spread out on a surface via the electrowetting phenomena, as discussed above and in U.S. Pat. Nos. 6,538,823, 6,545,815, 6,891,682 and 6,936,196.

As discussed above in the context of FIGS. 1-4 the fluid can comprise a single droplet or two droplets. In the former case, for e.g., embodiments depicted in FIGS. 1 and 2, the fluid droplet can be moved along a portion of the transmission line. In the latter case, moving the fluid along a portion of the transmission line can also include moving at least two droplets relative to each other (e.g., towards or away from each other), with the transmission line located between the two droplets, as illustrated for the embodiments depicted in FIGS. 3 and 4, for example.

In some cases, moving the fluid comprises an optional step 530 of moving the fluid through a channel. Moving the fluid through the channel helps to constrain the fluid to a path along the control electrodes used for applying the voltages. Locating the fluid in a channel also prevents the inadvertent movement of the fluid when the apparatus or tuning device moves.

As a result of the change in the conductive path of the transmission line, caused by moving the fluid, one or more signal propagation characteristic of a transmission line is changed in step 540. For instance, moving the fluid can change a resonance frequency of a signal passing through the transmission line, in step 550. Moving the fluid can also change a filter response of the transmission line, in step 560, by changing the path length (e.g., the resonator length) that the signal transverses through the transmission line.

In some cases the method 500 can further include a step 570 of immobilizing the fluid. For example, when the fluid comprises a photopolymerizable liquid, the fluid can be polymerized by exposing it to the appropriate wavelength of light. Solidification of the fluid sets the conductive path through the transmission line, thereby locking-in the signal propagation characteristic of the transmission line.

Figure 6:
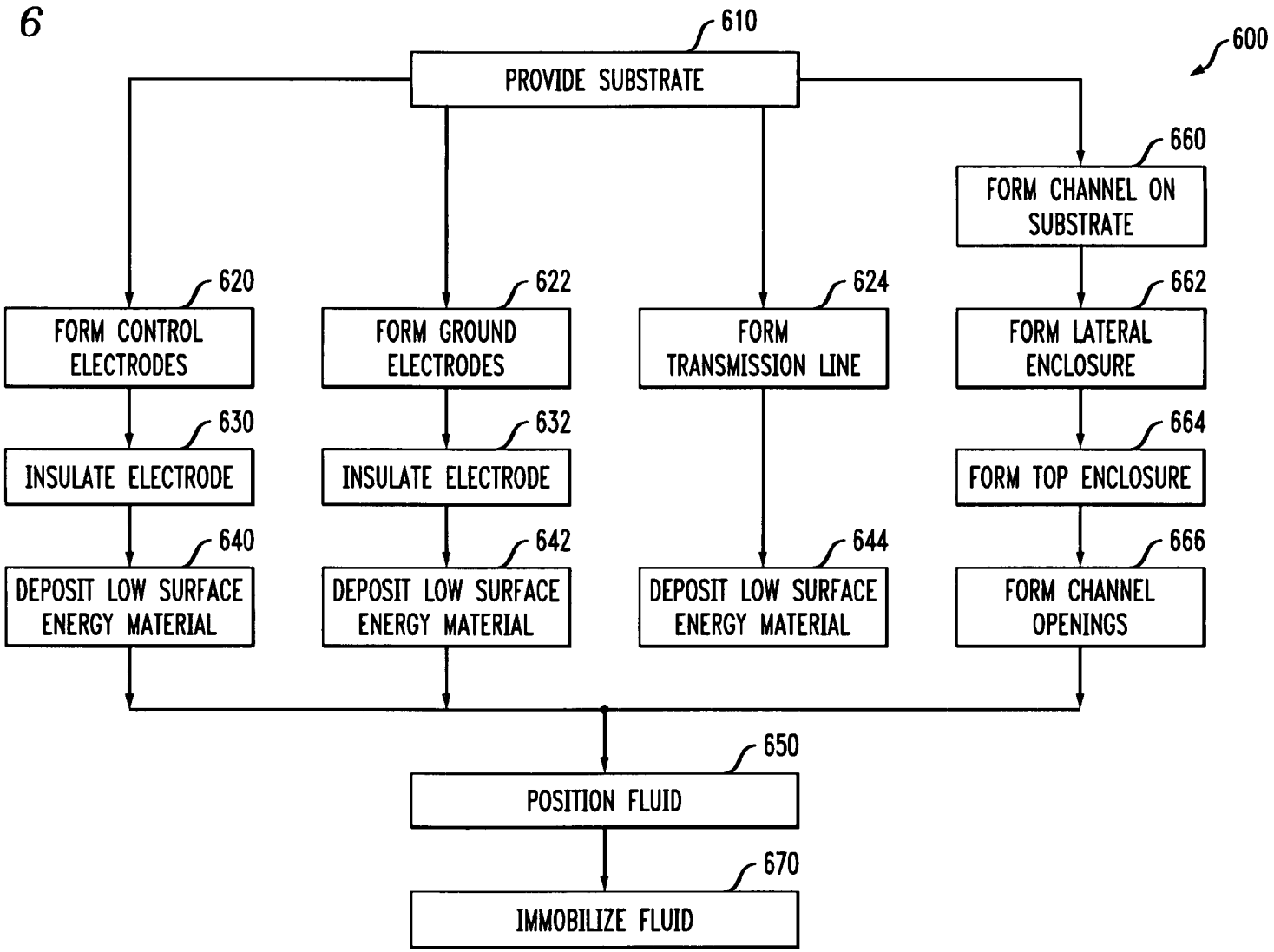
FIG. 6 presents a flow diagram of a method at selected stages of manufacturing an exemplary embodiment of an apparatus.

Still another embodiment is a method of manufacture. FIG. 6 presents a flow diagram showing selected manufacturing steps of the method. Any of the above-described embodiments of apparatuses and their tuning device could be manufactured by the method.

The method includes manufacturing a tuning device. The manufacture of the tuning device comprises a step 610 of providing a substrate. The substrate can comprise any of the materials discussed above in the context of FIG. 1. For example, in some preferred embodiments the substrate comprises a high speed electrical board material such as ceramic filled polytetrafluoroethylene (PTFE) composites like RO3003™, or as glass microfiber reinforced PTFE composites like RT/duroid® 5880 (Rogers Corporation, Rogers, Conn.).

Manufacturing the tuning device further comprises steps 620, 622, 624 of forming one or more each of a ground electrode a controlling electrode, and a transmission line respectively, over the substrate. Any conventional photolithographic procedures can be used to define and form these components. In some cases, for example, the microstrip lines, tuning stubs and hybrid coupler shown in FIG. 1 are simultaneously formed on the substrate in a single series of photolithography steps via conventional PCB manufacturing techniques, such as contact mask lithography. Of course, in other cases, the transmission line, ground electrode and controlling electrode can be formed separately.

Forming the control or ground electrodes in steps 620 and 622, respectively, also comprises electrically insulating these electrodes in steps 630, 632, respectively. Although forming the insulator over these electrodes is shown as separate steps, in some cases it is preferable to perform this in a single step on both electrodes simultaneously. Any of the insulating materials discussed in the context of FIG. 1 could be deposited on the control and ground electrodes. In some cases for example a silicon nitride over the control and ground electrodes, by chemical vapor deposition (CVD). Of course, the transmission line is not insulated because it makes electrical contact with the electrically conductive fluid.

Forming the controlling electrode, ground electrode, and the transmission line in steps 620, 622, 624 can also comprise optional steps 640, 642, 644 of depositing a low surface energy material over the controlling electrode, ground electrode, and the transmission line, respectively. Alternatively, the controlling electrode, ground electrode, and the transmission line could be covered simultaneously in a single step. Any of the low surface energy material discussed in the context of FIG. 1 can be deposited over these components, and in some cases, over the entire substrate surface that these components are located on. In some cases, for example, a low surface energy material comprising a fluoropolymer such as Cytop® can be deposited by spinning or dip coating.

Manufacturing the tuning device further comprises a step 650 of positioning an electrically conductive fluid so as to be electrically coupled to the transmission line, and in contact with the ground electrode and the controlling electrode. For example, a liquid dispenser such as a pipette can be configured to be positioned over these components using micromanipulator and then dispense a predefined volume of fluid.

Manufacturing the tuning device can further include an optional step 660 of forming a channel. As discussed above, in the context of FIG. 1, the channel can be formed so that it encloses the controlling and ground electrodes. Forming the channel can include a step 662 of forming lateral enclosures configured to constrain the lateral movement of the fluid over the substrate. Forming the channel can also include a step 664 of forming a top enclosure on the lateral enclosures so that the channel encloses the fluid on three sides. Forming the channel can also comprise a step 666 of forming a plurality of openings in the channel enclosures such that the fluid is locatable between at least two of the openings. In some cases, one or more of the openings can be advantageously used to facilitate the positioning of the fluid as described for step 660.

Forming the channel can include machining the lateral and top enclosures from solid insulating materials. Examples of suitable material were presented above in the context of FIG. 1. In some cases, for example, the channel enclosures are made of low surface energy materials, such as fluoropolymers, or solid materials coated low surface energy materials. These components can then be assembled on the substrate using a micromanipulator. In some cases, it is advantageous for the top enclosure to be made of a material (e.g., glass) that is transparent to a light configured to initiate the solidification of the fluid.

The manufacture of the tuning device can also include the optional step 670 of further comprising immobilizing the fluid. Preferably the fluid is immobilized in a location that is defined by the desired signal propagation characteristic. For example the fluid can be moved to the location that provides the desired signal propagation characteristic in the transmission line and then solidified. In some the fluid is solidified by initiating a polymerization reaction by illuminating a photoinitiator included in the fluid of course polymerization could be initiated thermally, or by any number of other means that are well know to those skilled in the art.

Although the present invention has been described in detail, those of ordinary skill in the art should understand that they could make various changes, substitutions and alterations herein without departing from the scope of the invention.

What is claimed is:

1. An apparatus comprising:

a tuning device comprising:

at least one control electrode and a ground electrode located over a substrate;

an electrically conductive fluid in contact with said at least one control electrode and said ground electrode; and at least one electrical transmission line electrically coupled to said fluid, said transmission line configured to transmit a signal, wherein said fluid is configured to move when a voltage is applied between said ground electrode and said at least one control electrode, said movement changing a propagation characteristic of said signal.

2. The apparatus of claim 1, wherein said propagation characteristic comprises a resonance frequency of said signal.

3. The apparatus of claim 1, wherein said propagation characteristic comprises a filter response of said transmission line.

4. The apparatus of claim 1, wherein said fluid comprises a one or more droplets.

5. The apparatus of claim 1, wherein said fluid is capable of being solidified.

6. The apparatus of claim 1, wherein said a tuning device further comprises a channel on said substrate, said fluid being located in said channel.

7. The apparatus of claim 6, wherein said channel comprises at least two openings.

8. The apparatus of claim 1, wherein said transmission line comprises a microstrip line or a coplanar waveguide.

9. The apparatus of claim 8, wherein said transmission line is further electrically coupled to a hybrid coupler.

10. The apparatus of claim 1, wherein said tuning device comprises one of variable phase shifter, a resonator or a filter.

11. The apparatus of claim 1, wherein said tuning device is a component of a radio-frequency tuning network.

12. The apparatus of claim 1, wherein said transmission line is further electrically coupled to a complex load.

13. A method, comprising, changing a signal propagation characteristic of a transmission line, comprising:

applying a voltage between at least one control electrode and a ground electrode, both of said electrodes being in contact with an electrically conductive fluid; and moving said electrically conductive fluid, thereby changing a conductive path of said transmission line that is electrically coupled to said fluid.

14. The method of claim 13, wherein moving comprises moving said fluid through a channel.

15. The method of claim 13, wherein moving comprises moving at least two droplets of said fluid relative to each other.

16. The method of claim 13, wherein said moving changes one or more of a resonance frequency of a signal passing through said transmission line or a filter response of said transmission line.

17. The method of claim 13, further comprising immobilizing said fluid, thereby locking-in said signal propagation characteristic.

18. A method, comprising:

manufacturing a tuning device, comprising:

forming one or more each of a transmission line, a ground electrode and a controlling electrode over a substrate; and positioning an electrically conductive fluid to be electrically coupled to said transmission line, and in contact with said ground electrode and said controlling electrode.

19. The method of claim 18, further comprising forming a channel on said substrate, said channel enclosing said one or more ground electrode and controlling electrode.

20. The method of claim 18, further comprising immobilizing said fluid.

* * * * *